US006533265B1

(12) United States Patent
Baldini

(10) Patent No.: US 6,533,265 B1
(45) Date of Patent: Mar. 18, 2003

(54) NEAT JOB OFFSET

(75) Inventor: Gerardo E. Baldini, Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 20 days.

(21) Appl. No.: 09/976,204

(22) Filed: Oct. 11, 2001

(51) Int. Cl.[7] ..... B65H 31/00; B65H 29/50; B65H 29/20; B65H 31/34; B65H 29/00

(52) U.S. Cl. ..... 271/207; 271/200; 271/314; 414/788.9; 414/791.2

(58) Field of Search ..... 271/200, 207, 271/314, 286; 414/788.9, 791.2; 270/58.27

(56) References Cited

U.S. PATENT DOCUMENTS 3,994,487 A * 11/1976 Wicklund ..... 271/314
4,236,856 A * 12/1980 Mol et al. ..... 414/791.2
4,480,825 A * 11/1984 Landa ..... 271/81
4,635,920 A * 1/1987 Kodama ..... 271/81
4,981,293 A * 1/1991 Yamashita et al. ..... 271/184
4,989,853 A * 2/1991 Matysek et al. ..... 270/58.3
5,012,297 A * 4/1991 Yamashita et al. ..... 399/405
5,088,721 A * 2/1992 Suzuki et al. ..... 271/293
5,219,159 A * 6/1993 Malachowski et al. ..... 271/228
5,273,274 A * 12/1993 Thomson et al. ..... 271/228
5,513,839 A * 5/1996 Green ..... 270/58.07
6,047,960 A * 4/2000 Kawano et al. ..... 271/184
6,209,865 B1 * 4/2001 Regimbal et al. ..... 271/220
6,227,531 B1 * 5/2001 Guerrero et al. ..... 270/58.31
6,231,039 B1 * 5/2001 Chung ..... 270/58.01
6,264,194 B1 * 7/2001 Hayashi et al. ..... 271/220
6,290,220 B1 * 9/2001 Takehara et al. ..... 270/58.12

* cited by examiner

*Primary Examiner*—Donald P. Walsh
*Assistant Examiner*—M Kohner

(57) ABSTRACT

Transfer media is positioned with a positioning apparatus. The apparatus has an output repository, a sensor, a controller, a lateral transporter, and a longitudinal conveyor. The output repository has an offset edge axis. The sensor is configured to sense a lateral position of the media relative to longitudinal alignment with the offset edge axis of the output repository and output an alignment signal responsive to the sensed lateral position of the media longitudinally aligning with the offset edge axis of the output repository. The controller is configured to output a lateral movement signal in absence of an alignment signal from the sensor and output a longitudinal movement signal. In response to the lateral movement signal from the controller, the lateral transporter laterally transports the media towards alignment with the offset edge axis of the output repository. In response to a longitudinal movement signal from the controller, the longitudinal conveyor longitudinally conveys the media into the output repository, in longitudinal alignment with the offset edge axis.

16 Claims, 3 Drawing Sheets

NEAT JOB OFFSET

FIELD OF THE INVENTION

This invention relates in general to transfer media handling and, more particularly, to positioning of transfer media into an output repository.

BACKGROUND OF THE INVENTION

A number of document handling devices are known in the art for sorting and stacking documents, paper, and printable media. Documents, paper, and printable media will be referred to collectively as transfer media. Examples of these document handling devices include printers, such as laser and inkjet printers, copy machines, facsimile machines, and document scanning devices.

With each of these devices, stacks of documents are processed by the device to generate output jobs such as print jobs or facsimile output jobs. To aid in identifying individual output jobs, a number of techniques have been employed when delivering individual jobs to an output tray of a document handling device.

One technique for identifying jobs within an output tray of a document handling device entails stacking together the sheets of transfer media forming a job in offset positions, such that each job is offset from neighboring jobs. For example, it is known to sort sheets of transfer media on a tray such that individual jobs are offset by repositioning either the output or discharge rollers a fixed distance during transfer media delivery or output so as to deliver successive print jobs that are offset from adjacent print jobs. Alternatively, it is known to laterally reposition an output tray a fixed distance between neighboring print jobs such that adjacent print jobs will be offset from one another.

Repositioning either the output or discharge rollers a fixed distance during transfer media delivery or output often results in an untidy stack. While the transfer media is being repositioned, it often suffers a slight skew. The transfer media can also suffer skew while being processed by any paper handling components of the document handling devices. For example picking devices and transfer rollers induce skew. The skew is usually significant enough to cause misalignment of the transfer media edge with the desired location. This results in an untidy stack.

SUMMARY OF THE INVENTION

According to principles of the present invention, transfer media is positioned with a positioning apparatus. The apparatus has an output repository, a sensor, a controller, a lateral transporter, and a longitudinal conveyor. The output repository has an offset edge axis. The sensor is configured to sense a lateral position of the media relative to longitudinal alignment with the offset edge axis of the output repository and output an alignment signal responsive to the sensed lateral position of the media longitudinally aligning with the offset edge axis of the output repository. The controller is configured to output a lateral movement signal in absence of an alignment signal from the sensor and output a longitudinal movement signal. In response to the lateral movement signal from the controller, the lateral transporter laterally transports the media towards alignment with the offset edge axis of the output repository. In response to a longitudinal movement signal from the controller, the longitudinal conveyor longitudinally conveys the media into the output repository, in longitudinal alignment with the offset edge axis.

According to further principles of the present invention, the output repository also has a second offset edge axis and the apparatus has a second sensor. The second sensor is configured to sense a lateral position of the media relative to longitudinal alignment with the second offset edge axis of the output repository.

DETAILED DESCRIPTION OF THE INVENTION

Figure 1:
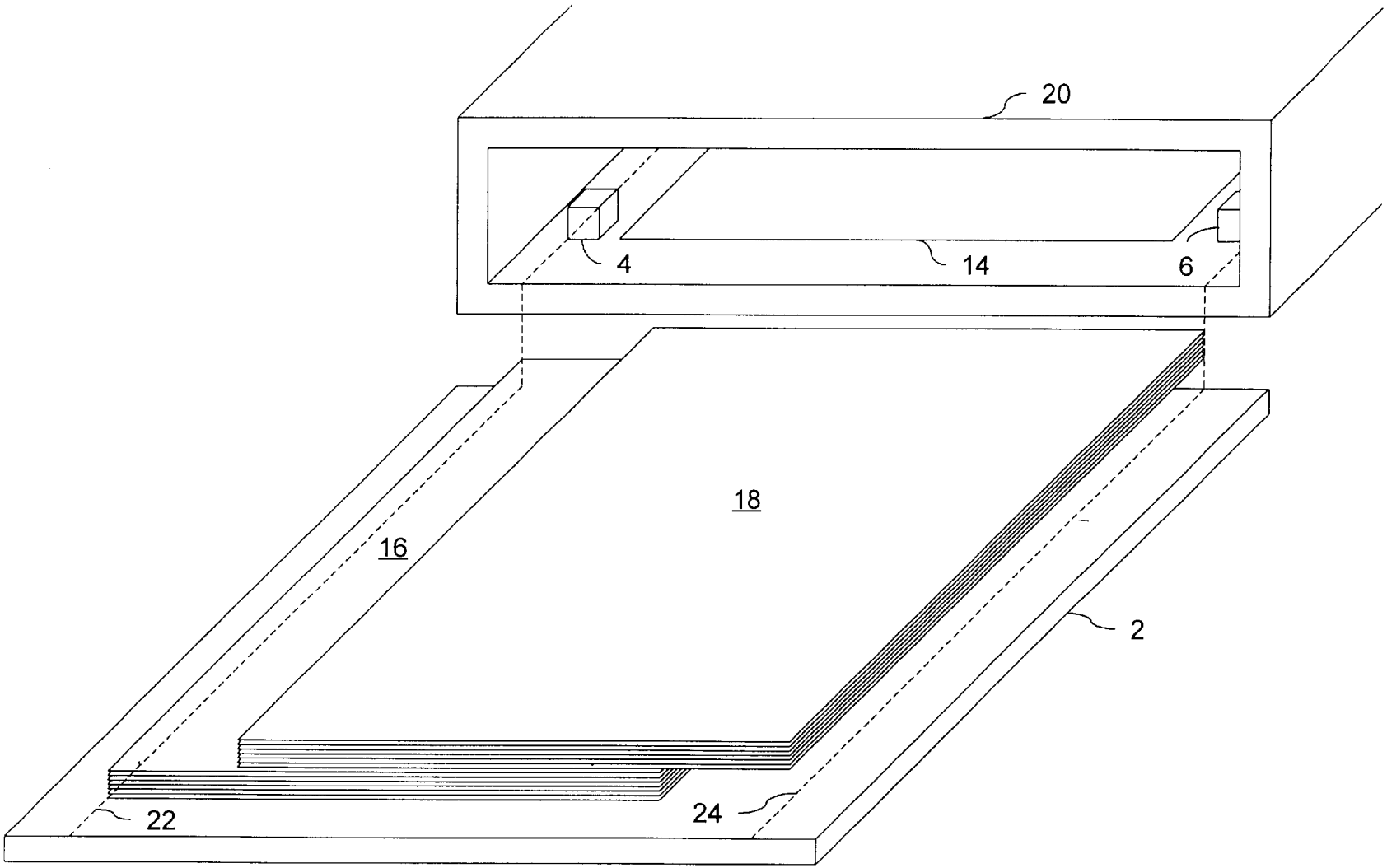
FIG. 1 is an orthogonal view, diagrammatically illustrating one embodiment of the apparatus for positioning transfer media of the present invention.
Figure 2:
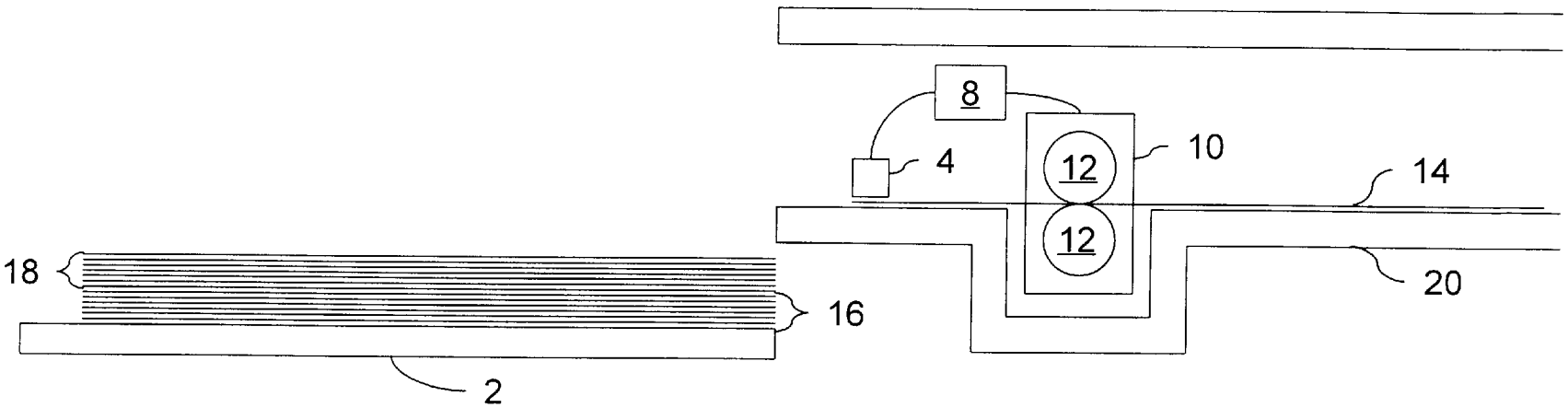
FIG. 2 is a cross-sectional view, further diagrammatically illustrating the apparatus for positioning transfer media of FIG. 1.

Illustrated in FIGS. 1 and 2 are an output repository 2, a sensor 4, 6, a controller 8, a lateral transporter 10, a longitudinal conveyor 12, transfer media 14, output jobs 16, 18, and enclosure 20. Enclosure 20 is not required for the present invention.

Output repository 2 is any output storage location for receiving transfer media 14. Examples of output repository 2 include output trays and output bins. Output repository 2 includes offset edge axes 22, 24. Offset edge axes 22, 24 each represent a desired location upon output repository 2 for an edge of transfer media 14 to align. Aligning one edge of transfer media 14 with axis 22 produces edge aligned output job 16. Aligning the other edge of transfer media 14 with axis 24 produces edge aligned output job 18.

Sensor 4 is any type of sensing device configured to sense a lateral position of transfer media 14 relative to longitudinal alignment with offset edge axis 22 and output an alignment signal responsive to the sensed lateral position of transfer media 14 longitudinally aligning with offset edge axis 22. Similarly, sensor 6 is any type of sensing device configured to sense a lateral position of transfer media 14 relative to longitudinal alignment with offset edge axis 24 and output an alignment signal responsive to the sensed lateral position of transfer media 14 longitudinally aligning with offset edge axis 24. Examples of suitable sensing devices for sensors 4, 6 include optical sensors and mechanical sensors.

Controller 8 communicates with sensors 4,6, lateral transporter 10, and longitudinal conveyor 12. Controller 8 is any device or system configured to output a lateral movement signal in absence of an alignment signal from sensors 4,6 and output a longitudinal movement signal. For example, controller 8 may include a computer, a processor, hardwired logic, analog or digital circuitry, or simple wire communications between sensors 4,6 and lateral transporter 10, and longitudinal conveyor 12.

Controller 8 may also include additional control functions configured to control other devices and processes related or unrelated to those of the present invention.

Lateral transporter 10 is any device or system configured to transport transfer media 14 towards alignment with axis 22 or axis 24. Controller 8 controls the direction of travel, either towards alignment with axis 22 or axis 24.

Similarly, longitudinal conveyor 12 is any device or system configured to convey transfer media 14 into output repository 2. A pair of output rollers is one example of longitudinal conveyor 12.

Figure 3:
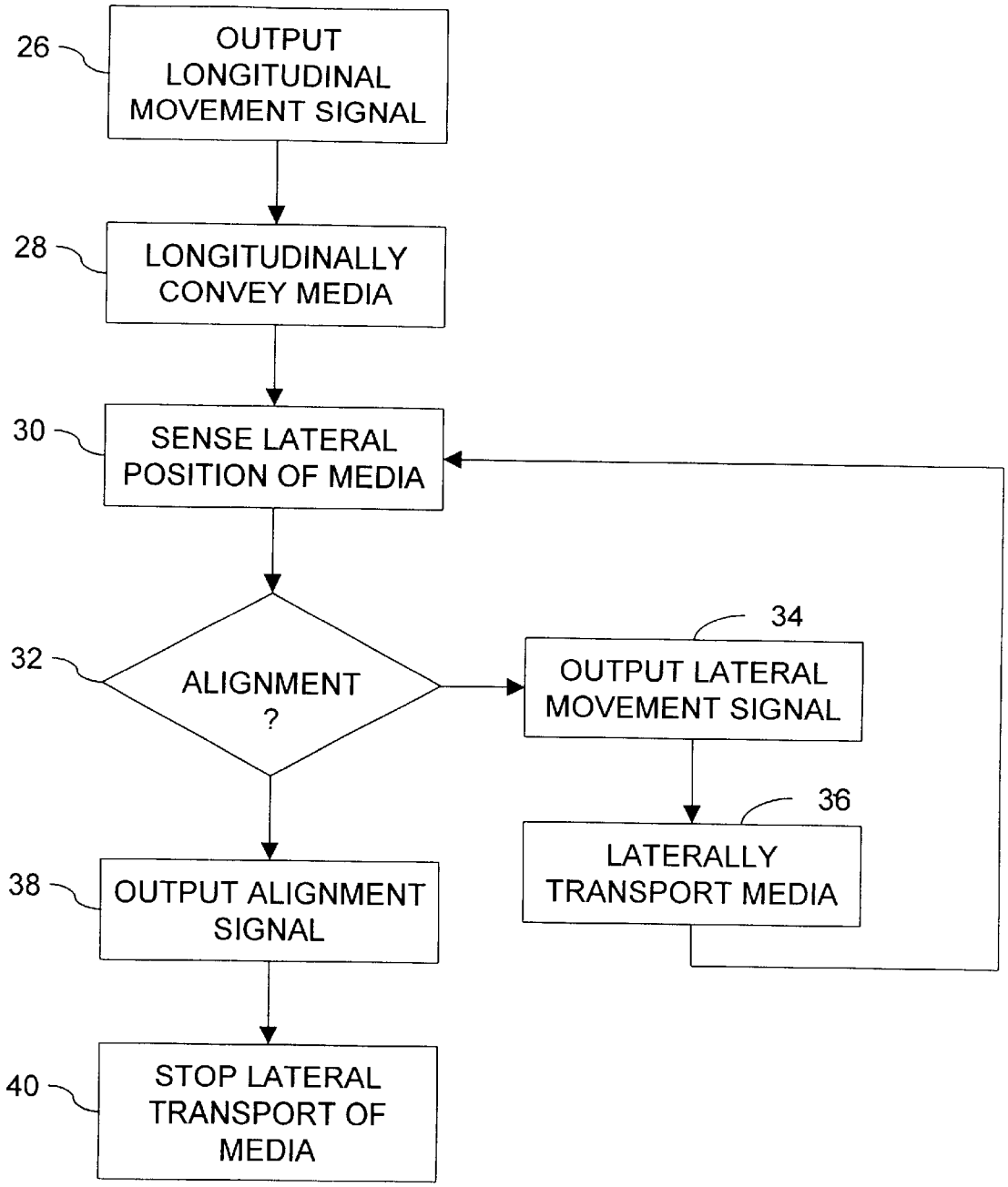
FIG. 3 is a flow chart illustrating one embodiment of the method for positioning transfer media of the present invention.

FIG. 3 is a flow chart representing steps of one embodiment of the present invention. Although the steps represented in FIG. 3 are presented in a specific order, the present invention encompasses variations in the order of steps. Furthermore, additional steps may be executed between the steps illustrated in FIG. 3 without departing from the scope of the present invention.

A decision is made, either by controller 8 or some other device or system, to align an edge of transfer media 14 with either axis 22 or axis 24. For clarity, the following description assumes axis 22 has been chosen. The process for axis 24 is similar to that for axis 22, except for the direction of travel of transfer media 14 and the sensor used.

Controller 8 outputs 26 a longitudinal movement signal. Longitudinal conveyor 12 receives the longitudinal movement signal and conveys 28 transfer media 14, in longitudinal alignment with the offset edge axis 22, into output repository 2. The longitudinal movement signal may be any useful signal, such as a simple switch signal or a voltage or current signal.

Sensor 4 senses 36 the alignment of a lateral position of transfer media 14 relative to longitudinal alignment with the offset edge axis 22. If the edge of transfer media 14 is not in alignment 32 with offset edge axis 22, sensor 4 does not output an alignment signal. Either no signal is output by sensor 4 or a nonalignment signal is output. The output from sensor 4 may be any useful signal, such as a simple switch output or a voltage or current output.

Controller 8 receives the signal or lack of signal from sensor 4 and outputs 34 a lateral movement signal. Lateral transporter 10 receives the lateral movement signal and transports 36 transfer media 14 towards alignment with axis 22. The lateral movement signal may be any useful signal, such as a simple switch signal or a voltage or current signal.

Sensor 4 continuously or periodically senses 32 the alignment of the lateral position of transfer media 14 relative to longitudinal alignment with the offset edge axis 22. If the edge of transfer media 14 is in alignment 32 with offset edge axis 22, sensor 4 outputs 38 an alignment signal. The alignment signal may be any useful signal, such as a simple switch signal or a voltage or current signal.

Controller 8 receives the alignment signal from sensor 4 and stops outputting 34 the lateral movement signal. Lateral transporter 10 responded to the lock of lateral movement signal by stopping 40 lateral movement of transfer media 14.

The foregoing description is only illustrative of the invention. Various alternatives and modifications can be devised by those skilled in the art without departing from the invention. Accordingly, the present invention embraces all such alternatives, modifications, and variances that fall within the scope of the appended claims.

What is claimed is:

1. An apparatus for positioning transfer media, the apparatus comprising:

(a) an output repository having an offset edge axis;

(b) a sensor configured to sense a lateral position of the media relative to longitudinal alignment with the offset edge axis of the output repository and outputting an alignment signal responsive to the sensed lateral position of the media longitudinally aligning with the offset edge axis of the output repository;

(c) a controller in communication with the sensor, the controller configured to output a lateral movement signal in absence of an alignment signal from the sensor and output a longitudinal movement signal;

(d) a lateral transporter in communication with the controller, the lateral transporter configured to respond to a lateral movement signal from the controller, by laterally transporting the media towards alignment with the offset edge axis of the output repository; and, (e) a longitudinal conveyor in communication with the controller, the longitudinal conveyor configured to respond to a longitudinal movement signal from the controller, by longitudinally conveying the media, in longitudinal alignment with the offset edge axis, into the output repository.

2. The apparatus of claim 1 wherein the longitudinal conveyer is carried by the lateral transporter.

3. The apparatus of claim 1 wherein the lateral transporter is carried by the longitudinal conveyer.

4. The apparatus of claim 1 wherein the sensor is selected from the group consisting of a mechanical sensor and an optical sensor.

5. The apparatus of claim 1 wherein the output repository includes a second offset edge axis and further including:

a second sensor configured to sense a lateral position of the media relative to longitudinal alignment with the second offset edge axis of the output repository and outputting a second alignment signal responsive to the sensed lateral position of the media longitudinally aligning with the second offset edge axis of the output repository;

wherein the controller is configured to output an opposite lateral movement signal in absence of a second alignment signal from the second sensor; and, wherein the lateral transporter is configured to respond to an opposite lateral movement signal from the controller, by laterally transporting the media towards alignment with the second offset edge axis of the output repository.

6. The apparatus of claim 1 wherein the controller is selected from the group consisting of a processor, logic circuitry, and analog circuitry.

7. The apparatus of claim 1 wherein the lateral transporter is selected from the group consisting of rollers, belts, and carriages.

8. The apparatus of claim 1 wherein the longitudinal conveyor is selected from the group consisting of rollers, belts, and carriages.

9. A method for positioning transfer media in an output repository having an offset edge axis, the method comprising:

(a) sensing a lateral position of the media relative to longitudinal alignment with the offset edge axis of the output repository;

(b) outputting an alignment signal responsive to the sensed lateral position of the media longitudinally aligning with the offset edge axis of the output repository;

(c) outputting a lateral movement signal in absence of the alignment signal;

(d) laterally transporting the media towards alignment with the offset edge axis of the output repository, in response to the lateral movement signal from the controller;

(e) outputting a longitudinal movement signal in response to an alignment signal from the sensor; and (f) longitudinally conveying the media, in longitudinal alignment with the offset edge axis, into the output repository, in response to a longitudinal movement signal from the controller.

10. An apparatus for positioning transfer media, the apparatus comprising:

(a) an output repository having first and second offset edge axes;

(b) a first sensor configured to sense a lateral position of the media relative to longitudinal alignment with the first offset edge axis of the output repository and outputting a first alignment signal responsive to the sensed lateral position of the media longitudinally aligning with the first offset edge axis of the output repository;

(c) a second sensor configured to sense a lateral position of the media relative to longitudinal alignment with the second offset edge axis of the output repository and outputting a second alignment signal responsive to the sensed lateral position of the media longitudinally aligning with the second offset edge axis of the output repository;

(d) a controller in communication with the first and second sensors, the controller configured to selectively output a lateral movement signal in absence of the first alignment signal from the first sensor, output an opposite lateral movement signal in absence of the second alignment signal from the second sensor, and output a longitudinal movement signal;

(e) a lateral transporter in communication with the controller, the lateral transporter configured to respond to a lateral movement signal from the controller, by laterally transporting the media towards alignment with the first offset edge axis of the output repository and to respond to an opposite lateral movement signal from the controller, by laterally transporting the media towards alignment with the second offset edge axis of the output repository; and, (f) a longitudinal conveyor in communication with the controller, the longitudinal conveyor configured to respond to the longitudinal movement signal from the controller, by longitudinally conveying the media into the output repository.

11. The apparatus of claim 10 wherein the longitudinal conveyer is carried by the lateral transporter.

12. The apparatus of claim 10 wherein the lateral transporter is carried by the longitudinal conveyer.

13. The apparatus of claim 10 wherein the first and second sensors are selected from the group consisting of a mechanical sensor and an optical sensor.

14. The apparatus of claim 10 wherein the controller is selected from the group consisting of a processor, logic circuitry, and analog circuitry.

15. The apparatus of claim 10 wherein the lateral transporter is selected from the group consisting of rollers, belts, and carriages.

16. The apparatus of claim 10 wherein the longitudinal conveyor is selected from the group consisting of rollers, belts, and carriages.

* * * * *